US006305965B1

(12) United States Patent
D'Inca

(10) Patent No.: US 6,305,965 B1
(45) Date of Patent: Oct. 23, 2001

(54) EQUIPMENT ASSEMBLY

(75) Inventor: Claudio D'Inca, Genoa (IT)

(73) Assignee: Marconi Communications S.p.A., Genoa (IT)

( * ) Notice: Subject to any disclaimer, the term of this patent is extended or adjusted under 35 U.S.C. 154(b) by 0 days.

(21) Appl. No.: 09/598,782

(22) Filed: Jun. 21, 2000

(30) Foreign Application Priority Data

May 10, 2000 (IT) ..... TO00A0431

(51) Int. Cl.[7] ..... H01R 13/627
(52) U.S. Cl. ..... 439/362
(58) Field of Search ..... 439/362, 363, 439/364, 322, 135, 136, 137, 141, 142

(56) References Cited

U.S. PATENT DOCUMENTS 4,997,305 * 3/1991 Yang ..... 403/322
5,324,209 * 6/1994 Falossi et al. ..... 439/362
5,348,494 * 9/1994 Falossi et al. ..... 439/362
5,368,496 * 11/1994 Ranalletta et al. ..... 439/261
5,383,795 * 1/1995 Falossi et al. ..... 439/362
5,733,137 * 3/1998 Knoop ..... 439/362
5,921,801 * 7/1999 O'Sullivan et al. ..... 439/362
6,053,758 * 4/2000 Kato et al. ..... 439/364
6,053,761 * 4/2000 Baron et al. ..... 439/378
6,120,313 * 9/2000 Luich et al. ..... 439/362
6,120,320 * 9/2000 Veiga et al. ..... 439/538

* cited by examiner

*Primary Examiner*—Tulsidas Patel
(74) *Attorney, Agent, or Firm*—Kirschstein, et al.

(57) ABSTRACT

An equipment assembly includes a housing and a sub-unit each having a large array of electrical contacts which mate when the sub-unit is inserted into the housing. The sub-unit has a plurality of threaded bolts which extend through the sub-unit to engage with cooperating threaded nuts secured to the housing. The plurality of bolts is linked together mechanically, so that all bolts engage simultaneously with their respective nuts, and draw the sub-unit into engagement with the housing as the bolts are rotated.

12 Claims, 2 Drawing Sheets

EQUIPMENT ASSEMBLY

BACKGROUND OF THE INVENTION

This invention relates to an equipment assembly, and is particularly applicable to such an assembly in which a large number of electrical contacts are made with an electrical backplane when a sub-unit is inserted into the equipment. Each individual electrical contact may be fragile and easily damaged, and although the force needed to make a single electrical contact, e,g., by inserting a conductive pin into a socket is small, the total force needed to make a large number, eg many hundred, of contacts simultaneously will be very large indeed. It is very difficult to apply such a large force to the sub-unit as a whole without serious risk of damage to individual electrical contacts.

SUMMARY OF THE INVENTION

The invention seeks to provide an improved equipment assembly in which this difficulty is reduced.

According to this invention, an equipment assembly includes a housing and a sub-unit, the housing and the sub-unit each having a large array of electrical contacts which mate when the sub-unit is inserted into the housing, the sub-unit having a plurality of threaded bolts which extend through the sub-unit to engage with cooperating threaded nuts secured to the housing, the plurality of bolts being linked together mechanically, so that all bolts engage simultaneously with their respective nuts, and draw the sub-unit into engagement with the housing as the bolts are rotated.

Preferably, two bolts are provided for each sub-unit, and preferably again the two bolts are spaced apart so that each is adjacent a side of the sub-unit. Preferably, the thread on each bolt is a single-start thread with the start position of all threads having approximately the same angular orientation with respect to the housing. This ensures that both bolts start to engage with its bolt at approximately the same time so as to minimize twist on the sub-unit which could damage the fragile electrical contacts.

In order to avoid overtightening the bolts, preferably a visual indication is given at the front surface of the housing or the sub-unit when the bolts are almost fully tightened. Preferably, the nuts are spring mounted in the housing to permit a slight amount of movement of the nuts relative to the housing so that the maximum required engagement force can be applied without having to fully or overtighten the bolts.

As a large insertion force is required, preferably a lever is provided which is mechanically linked to both bolts, so that rotation of the lever causes rotation of both bolts. Preferably, the lever has a predetermined rest position, so that the rest position of the start position of the threads is predetermined with respect to the bolts. This ensures that both threaded bolts engage the nuts at the same time. In order to provide a simple mechanical linkage between the two bolts, preferably they are arranged to rotate in mutually opposite senses—this means that one bolt has a right-hand thread, and the other bolt has a left-hand thread.

BRIEF DESCRIPTION OF THE DRAWINGS

The invention is further described by way of example with reference to the accompanying drawings which illustrate an equipment assembly in accordance with the invention, and in which.

DETAILED DESCRIPTION OF THE PREFERRED EMBODIMENTS

Figure 1:
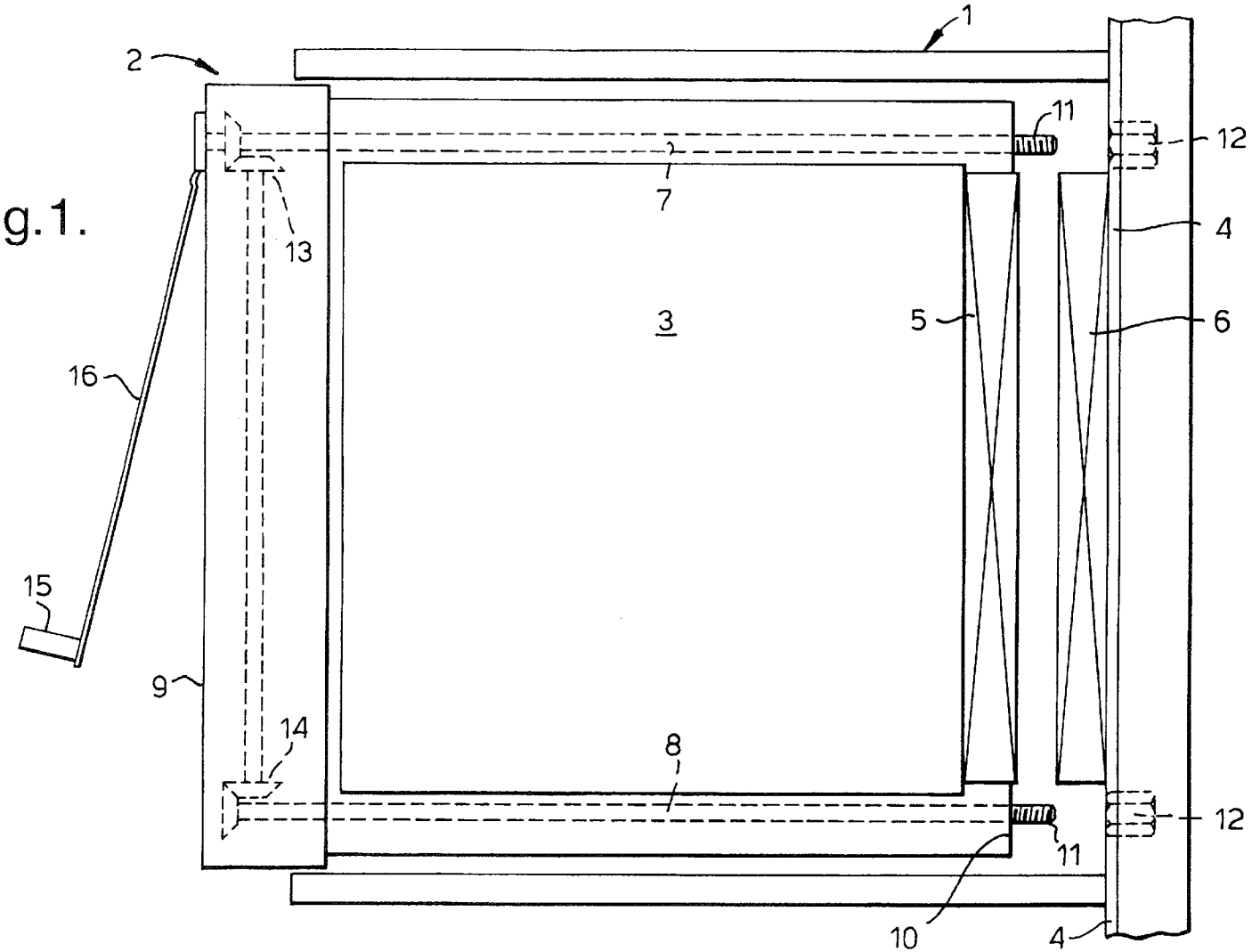
FIG. 1 shows a side view of an equipment assembly.

Referring to the drawings, the equipment assembly comprises a housing 1, and a sub-unit unit 2. The housing 1 is a strong and rigid structure designed to support a number of sub-units 2, each sub-unit typically weighing 10 kilograms. Sub-unit 2 carries four printed circuit boards 3, each of which has many electronic components on it, and which makes electrical connection to an electrical backplane 4 forming part of the housing 1. Typically a number of sub-units 2 will be mounted side by side in the housing to form a row of sub-units, and several tiers of rows will be provided one above the other. The individual sub-units 2 are interlinked electrically by circuits carried by the backplane 4, and each circuit board 3 of each sub-unit 2 is electrically connected to the backplane 4 by connector pairs 5 and 6.

In FIG. 1, the sub-unit 2 is shown partially withdrawn from the housing 1, so that connectors 5 and 6 are disengaged. In the assembled position, connectors 5 and 6 mate together to form continuous electrical paths from each circuit board 3 to the backplane 4. Typically the total number of pins in the connectors 5 of a particular sub-unit 2 is of the order of six to seven thousand, and a very high insertion force of about 5 kilograms is required to mate the connectors 5 and 6. Although the total insertion force is high, each pin of the connectors is fragile, and easily damaged.

The invention permits the sub-unit 2 to be inserted into and removed from the housing 1 in a controlled manner.

The sub-unit 2 is secured to the housing 1 by two long bolts 7, 8 extending from the front face 9 of the sub-unit 2 to its rear surface 10, the end of the bolts 7, 8 remote from the face 9 extending beyond the rear surface 10 and being threaded 11 so as to cooperate with threaded nuts 12 mounted on the housing 1.

The two bolts 7 and 8 are linked by a gear arrangement 13, 14 so that rotation of a handle 15 at the end of an arm 16 mounted on the head of the bolt 7 causes bolt 8 to rotate in the opposite sense. Thus, of the two bolts 7 and 8, one screw thread 11 is right-handed, and the other screw thread 11 is left-handed, as this simplifies the nature of the gear arrangement 13 and ensures that the sub-unit cannot be mounted the wrong way up.

The screw thread 11 is a single-start thread, and machined so that its start position relative to the screw thread of the nut 12 is known. The nuts are aligned with the bolts such that the screw threads of both bolts 7, 8 engage at the same time with the nuts 12, thereby ensuring that the sub-unit 2 is drawn towards the backplane 4 without tilt so that the connectors 5 and 6 engage smoothly.

Figure 4:
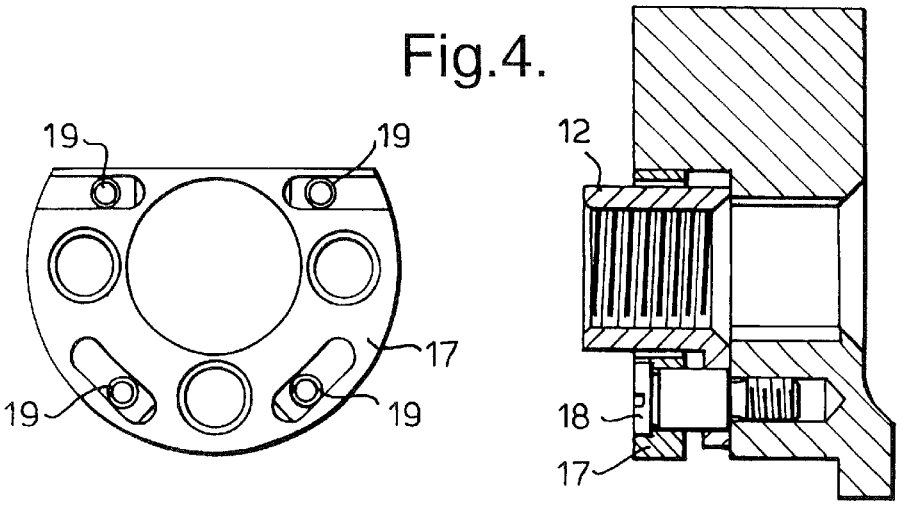
FIG. 4 shows a detail thereof.

Referring to FIG. 4, the arrangement of the nut 12 is shown in more detail. The nut 12 is located in a flange 17 which is secured to the frame of the housing 1 by means of three screws 18 (only one of which is shown). The nut 12 is slidably mounted within the flange 17 and is urged towards a position remote from the sub-unit 2 by means of four springs 19. When a bolt 7 or 8 enters a nut 12 and is tightened, the nut 12 is pulled forward against the spring, and a microswitch (not shown) is activated to warn a user not to overtighten the bolt, as overtightening could damage the sub-unit 2 or the connectors 5 and 6. A warning light 20, linked to the microswitch is mounted on the front surface of the sub-unit 2 so as to be visible to an operator.

Figure 2:
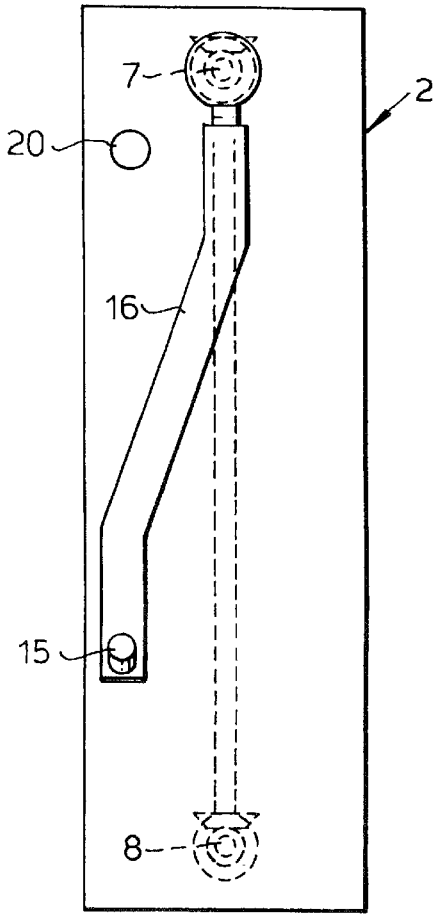
FIGS. 2 and 3 show front and rear views of part of the assembly.
Figure 3:
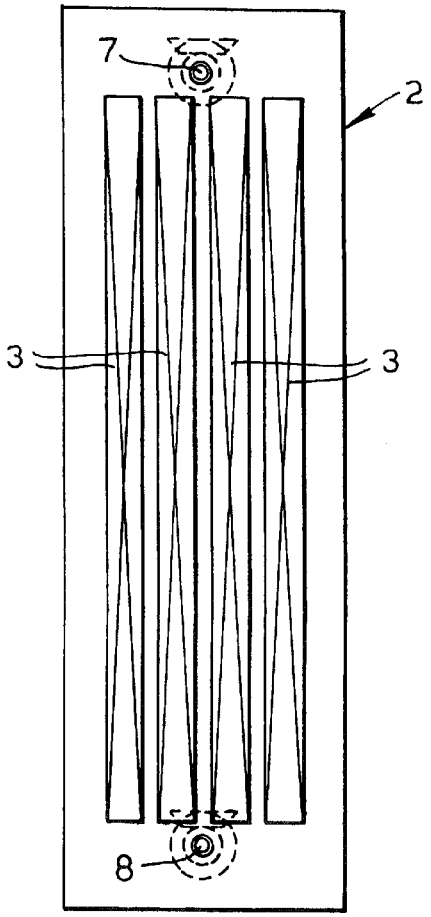

The use of two linked bolts 7 and 8 which are constrained to rotate simultaneously ensures that the sub-unit is drawn evenly into the housing 1. Were the two bolts to be operated independently, some degree of twist would result, giving rise to the possibility of damage to the connectors 5 and 6. When the sub-unit is offered up to the housing, the rest position of the arm 16 (as shown in FIG. 2) ensures that the start positions of the screw threads 11 are correctly orientated with respect to the screw threads of the nuts 12.

What is claimed is:

1. An equipment assembly, comprising:

a) a housing having a plurality of electrical contacts, and a plurality of threaded nuts secured to the housing;

b) a sub-unit insertable into the housing and having a plurality of electrical contacts which mate with the contacts of the housing upon insertion, the sub-unit having a plurality of threaded bolts extending through the sub-unit and respectively engaging the threaded nuts, the threaded bolts being mechanically linked together so that all the threaded bolts simultaneously engage the respective threaded nuts and draw the sub-unit into engagement with the housing as the threaded bolts are rotated; and c) a visual indicator for indicating at a front surface of one of the housing and the sub-unit when the threaded bolts are almost fully tightened.

2. The equipment assembly as claimed in claim 1, wherein two of the threaded bolts are provided for the sub-unit.

3. The equipment assembly as claimed in claim 2, wherein the two of the threaded bolts are spaced apart so that each of the two threaded bolts is adjacent a side of the sub-unit.

4. The equipment assembly as claimed in claim 1, wherein each threaded bolt has a single-start thread, and wherein all of the threads on the threaded bolts have a start position at approximately the same angular orientation with respect to the housing.

5. The equipment assembly as claimed in claim 4, wherein the start position is determined by a rest position of a handle arm linked to the threaded bolts.

6. The equipment assembly as claimed in claim 2, wherein the two of the threaded bolts are linked so as to rotate in mutually opposite senses.

7. An equipment assembly, comprising:

a) a housing having a plurality of electrical contacts, and a plurality of threaded nuts spring mounted in the housing; and b) a sub-unit insertable into the housing and having a plurality of electrical contacts which mate with the contacts of the housing upon insertion, the sub-unit having a plurality of threaded bolts extending through the sub-unit and respectively engaging the threaded nuts, the threaded bolts being mechanically linked together so that all the threaded bolts simultaneously engage the respective threaded nuts and draw the sub-unit into engagement with the housing as the threaded bolts are rotated.

8. The equipment assembly as claimed in claim 7, wherein two of the threaded bolts are provided for the sub-unit.

9. The equipment assembly as claimed in claim 8, wherein the two of the threaded bolts are spaced apart so that each of the two threaded bolts is adjacent a side of the sub-unit.

10. The equipment assembly as claimed in claim 7, wherein each threaded bolt has a single-start thread, and wherein all of the threads of the threaded bolts have a start position at approximately the same angular orientation with respect to the housing.

11. The equipment assembly as claimed in claim 10, wherein the start position is determined by a rest position of a handle arm linked to the threaded bolts.

12. The equipment assembly as claimed in claim 8, wherein the two of the threaded bolts are linked so as to rotate in mutually opposite senses.

* * * * *